United States Patent [19]

Wood, Jr. et al.

[11] Patent Number: 5,073,998

[45] Date of Patent: Dec. 24, 1991

[54] TOILET TANK COVER

[75] Inventors: Richard W. Wood, Jr., Villa Park, Calif.; Don R. Harris, deceased, late of Upland, Calif., by Barbara L. Harris, executrix

[73] Assignee: Gaylan Industries, Inc., Placentia, Calif.

[21] Appl. No.: 635,948

[22] Filed: Dec. 28, 1990

Related U.S. Application Data

[60] Division of Ser. No. 481,811, Feb. 20, 1990, Pat. No. 5,014,410, which is a continuation of Ser. No. 220,378, Jul. 11, 1988, abandoned, which is a continuation of Ser. No. 76,999, Jul. 22, 1987, abandoned, which is a continuation of Ser. No. 945,230, Dec. 23, 1986, abandoned, which is a continuation of Ser. No. 859,844, Apr. 30, 1986, abandoned, which is a continuation of Ser. No. 616,775, May 31, 1984, abandoned, which is a continuation of Ser. No. 314,460, Oct. 23, 1981, abandoned, which is a continuation-in-part of Ser. No. 126,839, Mar. 3, 1980, abandoned.

[51] Int. Cl.[5] ..... A47K 4/00

[52] U.S. Cl. ..... 4/661; 4/249

[58] Field of Search ..... 4/249, 252 A, 353, 412, 4/416, 661, DIG. 18, 213, 349

[56] References Cited

U.S. PATENT DOCUMENTS

| | | | |
|---|---|---|---|
| 850,989 | 4/1907 | Willms | 4/416 X |
| 948,657 | 2/1910 | Bailey | 4/353 |
| 1,032,317 | 7/1912 | Zwermann | 4/353 |
| 1,430,571 | 10/1922 | Leslie | 4/353 |
| 1,601,210 | 9/1926 | Haas | 4/412 X |
| 2,145,601 | 1/1939 | Hopper | 4/412 |
| 2,527,418 | 10/1950 | Harrington | 4/416 |
| 2,651,052 | 9/1953 | Madson | 4/252 A |
| 3,068,490 | 12/1962 | Pokras | 4/416 X |
| 3,166,112 | 1/1965 | Fisher | 4/661 |
| 4,368,551 | 1/1983 | Cummings | 4/661 |

*Primary Examiner*—Henry J. Recla
*Assistant Examiner*—Robert M. Fetsuga
*Attorney, Agent, or Firm*—Lyon & Lyon

[57] ABSTRACT

A toilet tank cover comprises a frame to surround an existing toilet tank, brackets for mounting the frame onto the tank, and an actuator for flushing the toilet which replaces the existing flush handle. The frame preferably includes a reservoir lid to permit access to the interior of the tank. The actuator includes a chain which may be attached to the flush valve and which may be operated from outside of the frame. Preferably, a return spring is provided to return the chain to its normal position and allow the valve to close after the toilet is flushed.

9 Claims, 2 Drawing Sheets

TOILET TANK COVER

CROSS REFERENCES

This application is a divisional of Ser. No. 07/481,811 filed Feb. 20, 1990, now U.S. Pat. No. 5,014,410; which is a continuation of Ser. No. 07/220,378 filed July 11, 1988 (abandoned); which is a continuation of Ser. No. 07/076,999 filed July 22, 1987 (abandoned); which is a continuation of Ser. No. 06/945,230 filed Dec. 23, 1986 (abandoned); which is a continuation of Ser. No. 06/859,844 filed Apr. 30, 1986 (abandoned); which is a continuation of Ser. No. 06/616,775 filed May 31, 1984 (abandoned); which is a continuation of Ser. No. 06/314,460 filed Oct. 23, 1981 (abandoned); which is a continuation-in-part of Ser. No. 06/126,839, filed Mar. 3, 1980 (abandoned), the specification of which is incorporated herein by reference.

BACKGROUND OF THE INVENTION

The present invention relates to toilet tank covers, and more particularly to covers which may be decorative and pleasantly attractive while simultaneously permitting simple and efficient operation of the toilet.

To provide a more attractive appearance to a toilet it has previously been necessary to remove the entire existing toilet tank and install in its place a box or frame which includes a replacement toilet tank within it. Such devices had a crude flush mechanism and were relatively expensive because of the need to replace the entire tank with its associated internal elements. Also, such tanks often had difficulties with moisture sealing, and frequently the toilet seat did not remain standing when lifted because of an inexact correspondence to the dimensions of the original tank.

SUMMARY OF THE INVENTION

According to the present invention there is provided a toilet tank cover which fits easily over most conventional toilet tanks and which includes a simple, reliable pull chain flush mechanism which replaces the standard flush handle and which attaches to any style of flush valve. The cover preferably includes a removable lid to provide access to the interior of the tank and noise-reducing means such as polyethylene foam pads which also provide a moisture seal underneath the lid. The pull chain is preferably spring loaded to permit the toilet flush valve to return to its closed position in a normal manner when the chain is released. Brackets are provided for supporting the cover on the existing toilet tank, and are preferably located on the interior of the frame. When the brackets are properly located, the cover normally will not interfere with the usual operation of the toilet seat.

Accordingly, it is an object of the present invention to provide an improved toilet tank cover which may be mounted on an existing toilet tank in a manner adaptable to most such tanks.

It is another object of the present invention to provide a toilet tank cover which will not interfere with the normal operation of the toilet seat.

It is a further object of the present invention to provide a simple and reliable flush mechanism for association with a toilet tank cover which replaces the existing flush handle and which may be attached to any style of flush valve.

These and other and further objects of the present invention will become apparent from the following detailed description, taken in conjunction with the accompanying drawings.

DETAILED DESCRIPTION OF THE PREFERRED EMBODIMENT

Figure 1:
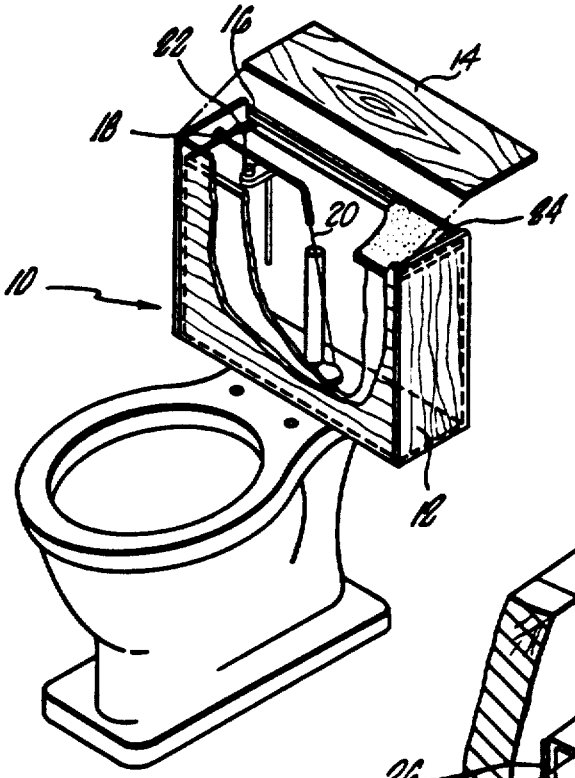
FIG. 1 is a perspective and partially broken view of a toilet tank cover according to the present invention, shown mounted on an existing toilet tank.

Referring first to FIG. 1, there is illustrated a toilet tank cover 10 according to the present invention, mounted upon an existing toilet tank. The cover 10 includes a frame 12 having two sides and a front, and a removable lid 14. For lower cost and lighter weight, as well as ease of installation, the frame 12 preferably has no back, but rather simply a backstrap or brace 16 extending between its two sides. Extending through one of the sides of the frame 12 is a downwardly curved chain housing 18 such as a brass tube, through which passes a chain 20 which may be connected to the existing flush valve in a manner to be described in greater detail hereinafter. A pair of brackets 22, only one of which is visible in FIG. 1, are mountable upon the interior surfaces of the sides of the frame, and rest upon the upper edge of the existing toilet tank. A pair of polyethylene foam seals 24 or the like, only one of which is shown in FIG. 1 and is broken for ease of illustration, may be placed within the frame 12 just underneath the lid 14 to provide a moisture seal and to help reduce the noise of the toilet flush mechanism. The seals may be provided in a standard size and trimmed if necessary to fit any particular installation requirements.

Figure 2:
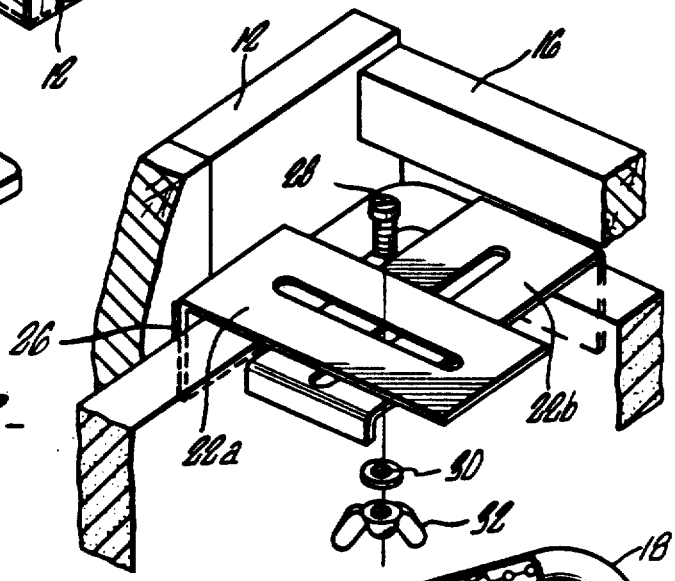
FIG. 2 is a detailed perspective view of the manner of mounting the brackets to the inside of the toilet tank cover and the manner of supporting the cover on an existing toilet tank.

Referring next to FIG. 2, there is illustrated a detailed view of the manner of attachment of the first preferred embodiment of brackets 22 to the frame 12 for supporting the frame 12 on the existing toilet tank. The brackets 22 preferably comprise a side-mounted L-shaped bracket **22*a* and a rear-facing L-shaped bracket 22*b*, and a similar set of brackets is provided on the opposite side of the frame 12. The side-mounted bracket 22*a* is preferably attached to the interior of the side of the frame 12 in the desired location by a piece of double-sided foam tape 26. Alternative means of attachment, of course, could be utilized. The placement of the side-mounted bracket 22*a* on the frame 12** will be determined by the size of the particular tank onto which the cover is to be mounted so that the tank is covered completely and the tank does not interfere with the pull chain apparatus.

The rear-facing bracket **22*b* may be attached to the side-mounted bracket 22*a* by fastening means such as a bolt 28 passing through coincident apertures in the brackets 22*a* and 22*b* and secured by a lock washer 30 and a wing nut 32. The brackets 22*a* and 22*b* should be adjusted with respect to each other so that when the wing nut 32 is tightened onto the bolt 28**, the interior surface of the front of the frame 12 is pressed against the front of the existing toilet tank and the rear-facing bracket 22*b* fits snugly over the rear of the upper edge of the tank. Such adjustment, coupled with a front portion of the frame 12 which is relatively thin, will insure that in most cases the toilet seat will remain in an upright position when lifted. A latch means (not shown) may be provided as an option to hold the seat upright when necessary.

Figure 4:
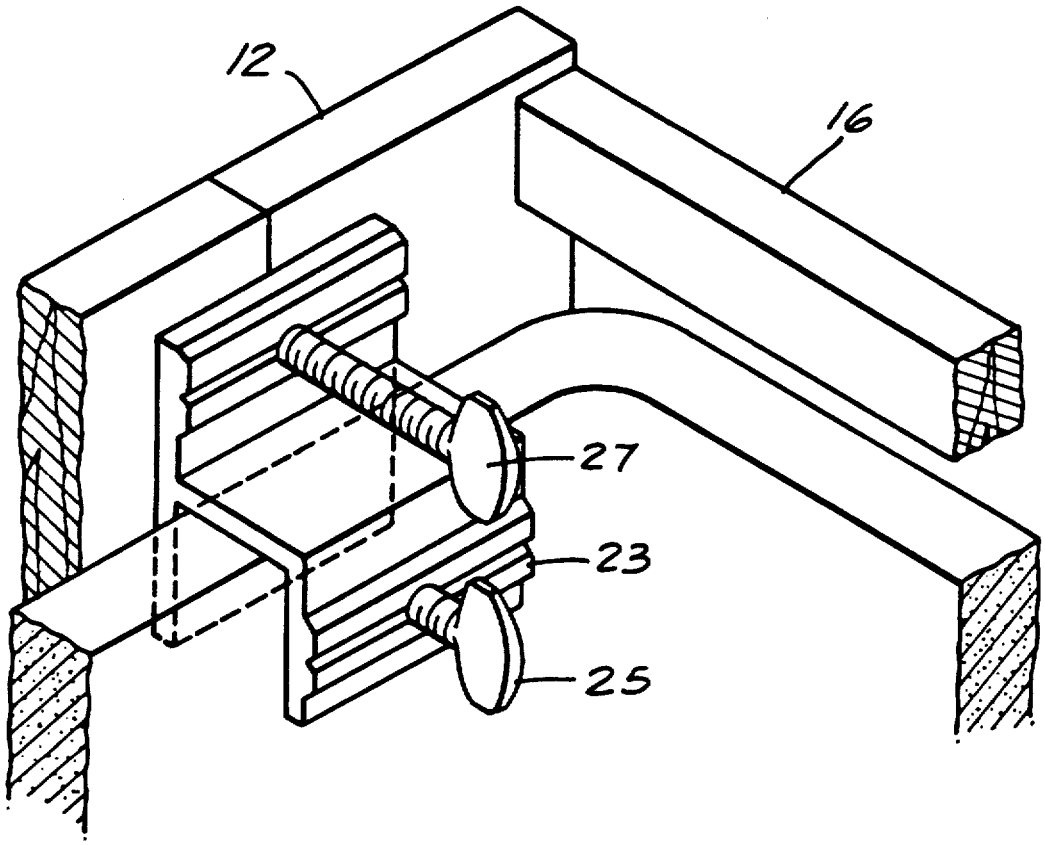
FIG. 4 is a perspective view of a second preferred bracket embodiment showing the manner of mounting the bracket to the cover and existing tank.

Referring now to FIG. 4, there is shown a second preferred embodiment of a bracket, 23, for supporting the frame 12 on an existing toilet tank. The bracket 23 has an h-shape and further has two threaded holes, an upper threaded hole and a lower threaded hole. A pair of such brackets 23, only one of which is visible in FIG. 4, is mounted on the top edge of opposing sides of an existing tank, one bracket on each side. The base of the h-shape fits over the top edge of a tank and is secured thereto by a threaded bolt 25, which is screw-threaded into the lower hole. The threaded bolt 25 has a blunt, substantially flat end which presses against an inner surface of a tank to hold the bracket 23 securely in place. A second threaded bolt 27 is screw-threaded into the upper threaded hole, in the upper arm of the bracket 23. The bolt 27 has a pointed end which pierces the wood, or other material of the frame 12, allowing the bolt 27 to be screw-threaded into the frame 12 to thereby secure the cover to an existing toilet tank.

Figure 3:
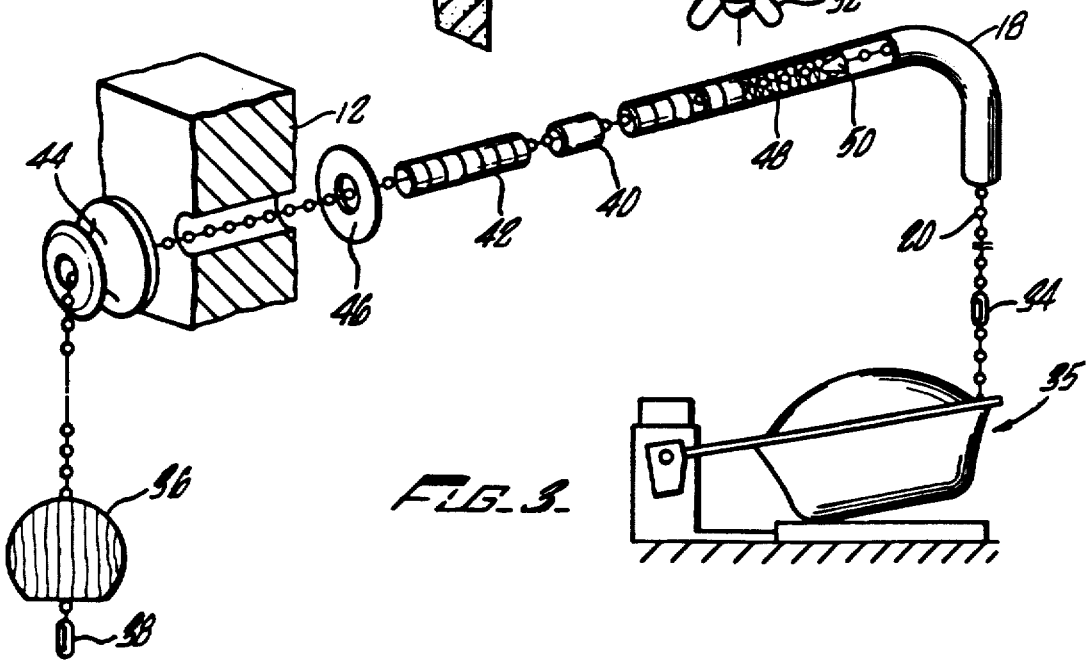
FIG. 3 is an exploded view of a flush mechanism according to the present invention, showing the manner of attachment thereof to the existing flush valve and to the toilet tank cover.

FIG. 3 is an exploded view of the flush mechanism. The mechanism extends through a side of the frame 12, as previously indicated, and includes the chain housing 18 through which passes the chain 20. The chain 20 may be attached to the flush valve 35 by cutting the existing chain connected to the valve 35 or by removing any rod or other connector attached to the valve 35 and attaching the chain 20 thereto by a chain connector 34 if a ball chain is connected to the valve 35 or by equivalent means such as a clip or the like if an eyelet or open chain is connected to the valve 35. In this manner the flush mechanism of the present invention may be attached to a flush valve of any commercially available style. At the other end of the chain 20 is attached a chain pull 36 which may be securely engaged with the chain 20 such as by a chain connector 38 attached to the end of the chain 20.

The flush mechanism is mounted on the frame 12 by threading a connector 40 onto the chain housing 18 and onto a close nipple 42 which extends through the frame 12 and is threaded at its other end onto a decorative nut 44. A washer 46 may be provided which is secured against the inside of the frame 12 by the connector 40.

Mounted within the chain housing 18 and surrounding the chain 20 passing therethrough is a coil spring 48. A chain retainer 50 is attached to the chain 20 adjacent the end of the spring 48 which is nearest the flush valve 35. When the chain pull 36 is pulled, thus activating the valve 35, the retainer 50 causes compression of the spring 48. When the chain pull 36 is released, the spring 48 expands to its normal position, exerting pressure on the retainer 50 and thus the chain 20 and allowing the valve 35 to close normally.

To mount the cover on an existing toilet tank, the tank is first emptied of water and then the existing lid and flush handle, together with the inside lever attached to the flush handle, are removed. The cover is then placed over the existing tank and may be held in place temporarily by pressing the cover against a piece of double-sided tape mounted on the front of the tank. The mounting brackets are then assembled and the double-sided tape is pressed onto the side-mounted brackets, which are then attached to the interior of the sides of the frame near the rear edges thereof. The rear-facing brackets are then adjusted to insure a snug fit against the upper edge of the tank and the wing nuts are tightened to secure the brackets together. Preferably the rear-facing brackets include a downwardly turned flange which may be adjustably abutted against the interior of the tank to prevent lateral movement of the cover.

The chain is then attached to the flush valve as previously described in connection with FIG. 3, and the toilet should operate in a normal manner when the chain is pulled. The polyethylene foam seals are then installed snugly above the brackets, making a slit in one if necessary to accommodate the chain housing. The lid is then placed onto the frame and assembly of the cover is completed.

The chain housing and chain, together with the associated hardware, are typically of brass, although the portion of the chain that is immersed in water may be nickel-plated to help prevent oxidation or corrosion. The spring may be of zinc plate. All threads should be one-eighth (⅛th) IPS, and the chain housing typically has an outside diameter of three-eighths (⅜th) inches. For attractiveness, the cover may be made of a hardwood such as oak, with a lacquer or similar finish, or may be molded of plastic in a variety of colors.

It will be apparent from the foregoing description that there has been provided by the present invention an improved toilet tank cover which is adaptable to a variety of sizes of toilet tanks and which includes a flush mechanism which is simple to use and reliable in operation. While a presently preferred embodiment of the present invention has been illustrated and described, many modifications and variations thereof will be apparent to those skilled in the art given the teachings herein, and it is intended that all such modifications and variations be encompassed within the scope of the appended claims.

What is claimed is:

1. A decorative cover for a standard toilet tank with a top opening and a flushing mechanism therein, comprising:

a frame adapted to surround a toilet tank, said frame including a front portion, two side portions and a removable lid portion, said frame being adapted to surround said front and two side portions of said toilet tank and said removable lid portion providing access to the top opening of the toilet tank, the frame being open at the bottom thereof;

a bracket means for supporting said frame and for positioning the front portion and the two side portions of said frame to establish a gap between the frame portions and the sides of the toilet tank, said bracket means constructed and arranged to engage an inner surface of said frame and an upper edge of the tank;

an actuator means for actuating the flushing mechanism, the actuator means adapted to extend above the sides of the toilet tank and through an aperture means in said frame, the actuator means adapted to be connected to a handle means external to said frame; and a moisture sealing means positioned below said lid portion for providing a moisture seal of the top opening of the tank.

2. A decorative according to claim 1 wherein the actuator means comprises a chain extending through the aperture means in said frame adapted to be connected at a first end to a tank flush valve and at a second end to the handle means located external to said frame and a spring means acting on said chain to allow the flush valve to return to its closed position after said chain has been released, said handle means comprising a chain pull.

3. A toilet tank cover according to claim 2 further including including a spring compression means connected to said chain and adapted to engage and compress said spring means when said chain is pulled, whereby said chain is returned to its resting position by said spring means when said chain pull is released and said flush valve is thereby returned to its closed position.

4. A toilet tank cover as in claim 1 wherein said bracket means comprises a bracket set corresponding to each side portion of said frame, each bracket set comprising a pair of L-shaped brackets having longitudinal slots therein, a first of said brackets being adapted to be affixed to an inner surface of one of said portions of said frame and a second of said brackets being adapted to engage the upper rear edge of the tank at substantially right angles to said first bracket, each of said bracket means further comprising fastening means for extending through said longitudinal slots and fastening said brackets together.

5. A toilet tank cover as in claim 1 wherein said bracket means comprises an h-shaped bracket corresponding to each side portion of said frame, each h-shaped bracket having its base fitting over a top edge of the toilet tank and secured thereto by a first threaded bolt and the upper arm of the h-shaped bracket being secured to an inner side of the frame by a second threaded bolt.

6. A toilet tank cover as in claim 1 wherein the moisture sealing means comprises a sheet of polyethylene foam constructed and arranged to cover the entire top opening of the toilet tank.

7. A decorative toilet tank cover adapted for ease of installation on various existing toilet tanks, comprising:

a decorative frame adapted to surround an existing toilet tank and comprising two sides, a rear brace piece connecting the upper rear corners of the sides and being of relatively small dimensions and located above the toilet tank for ease of installation, and a front piece connected to the front edges of the sides;

a decorative removable lid which fits onto the top of the frame;

a mounting means for hanging the frame from the top edge of an existing toilet tank and for positioning the sides of said frame in a non-contacting relationship with sides of the toilet tank;

sealing means adapted to be located above the top edge of the toilet tank; and actuator means for actuating a flush mechanism within the toilet tank, the actuator means being connectable at one end to the flush mechanism.

8. A decorative toilet tank cover adapted for ease of installation on various toilet tanks comprising:

a decorative frame adapted to surround an existing tank and comprising two side pieces with one side piece having an aperture above a top edge of the existing tank, a rear brace piece connecting upper rear corners of the side pieces and being of relatively small dimensions and located above the existing tank for ease of installation, and a front piece connected to front edges of the side pieces;

a decorative removable lid which fits onto the top of the frame;

a mounting means for hanging the frame from a top edge of the existing tank and for positioning the side pieces to maintain a gap between sides of the existing tank and the side pieces; and sealing means for sealing off the top opening of the toilet tank, the sealing means constructed and arranged to be positioned above the top edge of the toilet tank and made of a material which is easily cut or torn for ease of installation.

9. A toilet tank cover as in claim 8 further comprising an actuator means having a chain adapted to be connected at one end to an existing flush mechanism within the tank, extending above the top edge of the tank, and connected at the other end to a chain pull located external to said frame, a spring adapted to pull the chain when the chain pull is released to thereby release an existing flush valve, and a chain housing with one end supported at the aperture and the other end hanging above the area of the existing flush valve, said chain housing being located substantially above the top edge of the existing tank and containing the spring and a substantial portion of the chain to prevent the chain and spring from fouling in the tank hardware.

* * * * *

UNITED STATES PATENT AND TRADEMARK OFFICE

CERTIFICATE OF CORRECTION

PATENT NO. : 5,073,998

DATED : December 24, 1991

INVENTOR(S) : Richard W. Wood, Jr., and Don R. Harris, deceased

It is certified that error appears in the above-identified patent and that said Letters Patent is hereby corrected as shown below:

Title page, item [60], under Related U.S. Application Data, second line, the patent no. should be changed from "5,014,410" to --5,027,493--.

In column 1, line 6, change "5,014,410" to read --5,027,493--.

Signed and Sealed this

Third Day of August, 1993

*Attest:*

Michael K. Kirk

MICHAEL K. KIRK

*Attesting Officer*

*Acting Commissioner of Patents and Trademarks*